United States Patent [19]

Tinkle

[11] 3,984,137

[45] Oct. 5, 1976

[54] LOCK DEVICE

[76] Inventor: Roger Tinkle, 3035 Timlin Court, Roselawn, Ind. 46310

[22] Filed: July 14, 1975

[21] Appl. No.: 595,504

[52] U.S. Cl. ..... 292/269; 49/163; 49/394; 292/150; 292/277

[51] Int. Cl.[2] ..... E05C 1/04

[58] Field of Search ..... 49/163, 168, 394; 292/302, 277, 251, 269, 262, 150

[56] References Cited

UNITED STATES PATENTS

| | | | |
|---|---|---|---|
| 650,006 | 5/1900 | Haas | 292/263 |
| 934,180 | 9/1909 | Jenks | 292/262 |
| 1,544,387 | 6/1925 | Fulton | 292/277 X |
| 2,034,171 | 3/1936 | Barrett | 292/302 X |

*Primary Examiner*—Richard E. Moore
*Attorney, Agent, or Firm*—Walter Leuca

[57] ABSTRACT

A security lock which secures a building entrance against unauthorized entry by linking together the outer and inner doors against their respective door frame stops. This invention comprises link members wherein one member thereof is anchored to the outer door and the other member is a hinged link which passes through the inner door and is prevented from being withdrawn by a manually operated latch. When the security lock is not in use, the hinged link is pivoted out of the way.

2 Claims, 5 Drawing Figures

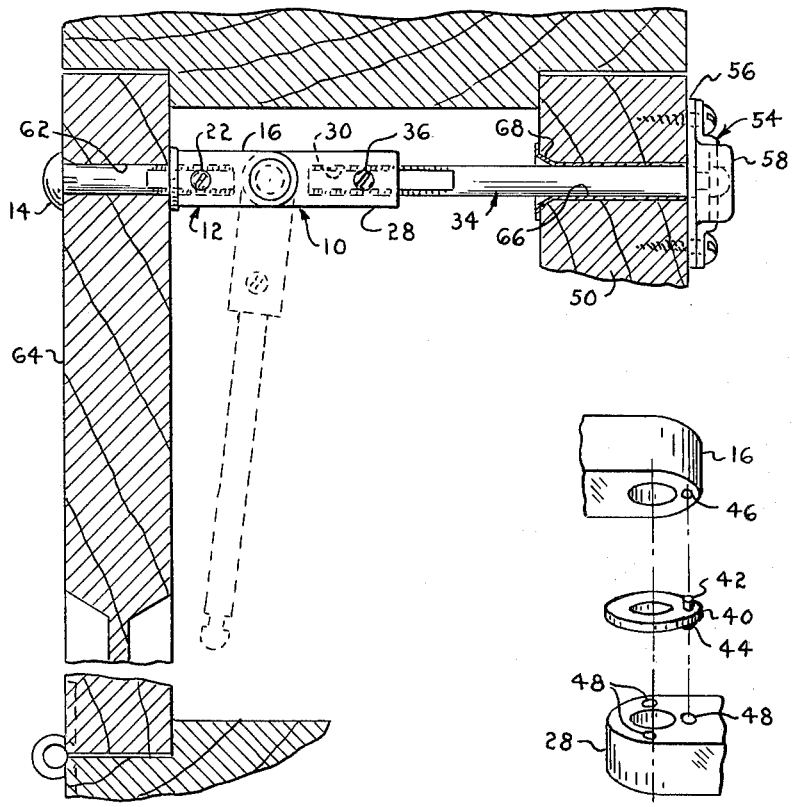
Fig.-1
Fig.-5
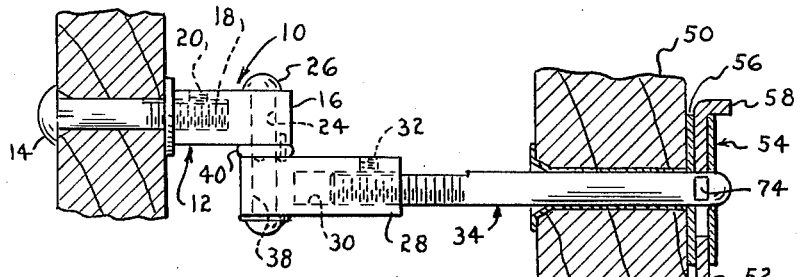
Fig.-2
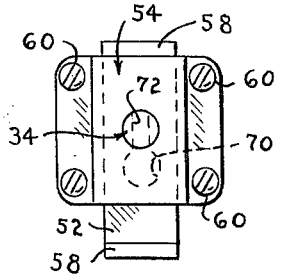
Fig.-4
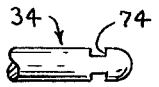
Fig.-3

LOCK DEVICE

BACKGROUND OF THE INVENTION

1. Field of the Invention

This invention relates generally to lock devices and more particularly to a lock bolt for securing a building entrance by linking together the outer and inner doors.

2. Description of the Prior Art

The problem that this invention is directed to is the complexity of prior art door locks. Prior art door locks are complex in structure, expensive, require special tools and skills for installation, and can often be opened or compromised by tampering.

SUMMARY OF THE INVENTION

Accordingly, I have invented a lock device which is simple and economical to manufacture and easy to install. It comprises a link member hinged to an anchor member. The anchor member is permanently affixed to the outer door of a building entrance. The distal end of the link member passes through a hole provided in the inner door and prevented from being withdrawn therefrom by a manually operable latch. Thus the outer and inner doors are linked together and drawn against their respective stops. My invention is a simple device comprising few movable parts. Installation of my invention is easily accomplished, using conventional tools. The lock is easily latched and unlatched. When latched, the lock is positive and is virtually impossible to compromise by tampering, since the hinged link is situated between two closed doors and the parts are configured in a manner that prevents disassembly of the hinged link. When the lock is not in use, the hinged link is pivoted out of the way to facilitate normal door operation.

Other objects and advantages of my invention will become more apparent after a careful study of the following detailed description taken together with the accompanying drawings which illustrate a preferred embodiment of my invention.

BRIEF DESCRIPTION OF THE DRAWINGS

FIG. 1 is a top view of my invention shown in operative relation with the outer and inner doors which are shown cross sectioned and in fragment. The phantom part of FIG. 1 illustrates an alternate position of the hinge link member of my invention;

FIG. 2 is a side view of my invention shown in operative relation with the outer and inner doors shown in fragment;

FIG. 3 is a detail view of the distal end of the hinge link member;

FIG. 4 is a front view of the latch assembly of my invention shown in operative relation with the distal end of the hinge link member; and FIG. 5 is a perspective detail view of the hinge joint showing the parts in exploded relation and in fragment.

DESCRIPTION OF THE PREFERRED EMBODIMENT

Referring now to the drawings wherein is illustrated a preferred embodiment of my invention, numeral 10 designates generally the lock device of my invention. It comprises an anchor link 12 which is formed by bolt 14 and pivot nut member 16. Pivot nut member 16 is provided with intersecting threaded holes 18 and 20 for receiving the threaded end of bolt 14 and set screw 22 respectively for securing the end of bolt 14 to pivot nut 16. Pivot nut member 16 is further provided with hole 24 for receiving therethrough pivot pin 26. A second pivot nut member 28 is similarly provided with intersecting threaded holes 30 and 32 for receiving the threaded end of hinge link 34 and a second set screw 36 respectively for securing the end of link 34 to nut member 28. Hole 38 is provided in the end of pivot nut member 28 which receives the end of pivot pin 26 extending from hole 24 of nut member 16. I prefer to provide a washer 40 formed with detents 42 and 44 which fit in matching recesses 46 and 48 respectively, provided in pivot nut members 16 and 28. Detent 42 in recess 46 serves as a key to hold washer 40 stationary relative to pivot member 16 and detent 44 is shaped to allow sliding movement in and out of recesses 48 in nut member 28 so that hinge link 34 may be positioned either in the extended or pivoted position. Of course, sufficient clearance between the pivot members is provided to allow easy movement of hinge link 34 and at the same time allow engagement of detent 44 in recesses 48 to position hinge link 34 by manual movement. I provide a spring member between the head of pivot pin 26 and pivot nut member 28 to provide a bias against washer 40 and thereby seat detent 44 in recesses 48 with a holding action. The distal end of hinge link 34 is necked by forming notches 74 therein by which means latch device 54 connects link 34 to inner door 50. Latch device 54 comprises a latch bar 52 slidably movable between latch cover plate 55 and base plate 56. Cover plate 55 is angled to form a channel to restrict latch bar 52 to a reciprocating movement. The ends 58 of latch bar 52 are horizontally angled to prevent accidental removal of latch bar 52 from the cover and base plate assembly and to provide an enlarged surface at the top and bottom ends of the latch bar to facilitate digital handling thereof. The latch assembly 54 is connected to the backside of inner door 50 by screws 60.

In the operation of this invention, a hole 62 is provided adjacent the open edge of outer door 64 for inserting bolt 14 therethrough. Bolt 14 is preferably formed with a rounded, slotless head in order that the head be not grasped for removal from the outside of the outer door. Pivot nut member 16 is threaded onto the threaded end of stud bolt 14 and tightened against the inside of outer door 64. Set screw 22 is screwed into threaded hole 20 to secure nut member 16 in place on the threaded end of bolt 14 thereby forming anchor link 12. A hole 66 is provided in inner door 50 adjacent the open edge thereof axially aligned with hinge link 34 when hinge link 34 is in its extended position. Hole 66 in inner door 50 is fitted with bushing 68 to prevent hole 66 from becoming enlarged by repeated use of the lock device 10 of this invention and also to provide a finished appearance to the hole. The threaded hole 30 in nut member 28 and the threaded portion of hinge link 34 are sufficiently extensive to allow longitudinal adjustment therebetween to accomodate different dimensions between inner door 50 and outer door 64 and to align notches 74 in the distal end of hinge link 34 with the plane of latch bar 52. Similarly the threaded end of bolt 14 and the threaded hole 18 of pivot nut member 16 are sufficiently extensive to allow anchor link 12 to be fitted to different thickness doors. When hinge link 34 is threaded in nut member 28 so as to position notches 74 of the distal end thereof in the plane of latch bar 52, set screw 36 is tightened against the threaded end of link member 34 to fix the link member in place. Latch bar 52 is provided with a hole 70 to receive therethrough the distal end of hinge link 34. Latch bar 52 is further provided with slotted aperture 72 which is shaped from hole 70 so that by sliding movement of latch bar 52, slotted aperture 72 engages notches 74 forming the necked portion of the distal end of hinge link 34 thereby securing the distal end of hinge link 34 to inner door 50.

When the lock device 10 of this invention is not in use, detent 44 of washer member 40 between nut members 16 and 28 frictionally engage one of recesses 48 provided in the facing surfaces of pivot nut member 28 to position hinge link 34 to its pivoted out of the way position shown in the dotted lines of FIG. 1. The other detent and recess engagement is provided to position hinge link 34 in the extended position aligned with the passageway of bushing 68 so that upon closing of inner door 50 from the inside, hinge link 34 is properly aligned to enter the passageway of the bushing without further guidance.

The inner and outer doors of a building thus secured by the lock device 10 of my invention effectively prevents forcible opening of the outer door, or surreptitious opening thereof by compromising the conventional lock thereof. Though the lock device of my invention is very simple, the unwanted opening of the outer door will be resisted by the abuttment of the inner door against the door stop on the door frame.

I claim:

1. The combination of: a jamb post means in a door frame assembly; a door hinged to close against the edge of said jamb post means; a second door having a hole therethrough hinged to close against the opposite edge of said jamb post means; an elongated member connected to said first mentioned door, said elongated member being longitudinally extensive to project the distal end thereof through said hole in said second door when said first mentioned door and said second mentioned door are closed against said edges of said jamb post means; and lock means on said second door for connecting said distal end of said elongated member to said second door.

2. The combination of claim 1 wherein said hole in said second door is further characterized as being adjacent said jamb post means, and said elongated member is further characterized as being pivotedly connected to said first mentioned door adjacent said jamb post means and in axial alignment with said hole when said elongated member longitudinally projects from said first mentioned door.

* * * * *